United States Patent [19]

Cromar et al.

[11] Patent Number: 4,986,359

[45] Date of Patent: Jan. 22, 1991

[54] RELEASE APPARATUS AND METHOD FOR THREADED CONDUCTOR PIPE

[75] Inventors: Stephen A. Cromar, Aberdeen; Gavin T. Reilly, Portlethen, both of Scotland

[73] Assignee: Vetco Gray Inc., Houston, Tex.

[21] Appl. No.: 509,989

[22] Filed: Apr. 16, 1990

[51] Int. Cl.[5] ..... E21B 19/16

[52] U.S. Cl. ..... 166/340; 166/77.5; 166/365; 166/377; 285/39

[58] Field of Search ..... 166/377, 379, 380, 77.5, 166/78, 85, 98, 340, 339, 344, 360, 365; 294/86.24; 285/39

[56] References Cited

U.S. PATENT DOCUMENTS

| | | | |
|---|---|---|---|
| 1,142,460 | 6/1915 | Roby | 175/257 |
| 2,924,434 | 2/1960 | Potter et al. | 285/3 |
| 3,171,674 | 3/1965 | Bickel et al. | 285/39 |
| 3,240,511 | 3/1966 | Bishop et al. | 166/377 X |
| 4,003,434 | 1/1977 | Garrett et al. | 166/377 |
| 4,688,632 | 8/1987 | Cooley, Jr. | 166/77.5 |
| 4,830,121 | 5/1989 | Krasnov et al. | 166/77.5 X |

*Primary Examiner*—Stephen J. Novosad
*Attorney, Agent, or Firm*—James E. Bradley

[57] ABSTRACT

A torque tool and mating profile allow large diameter conductor pipe to easily be retrieved from a subsea well. The profile will be located near the sea floor immediately above a left-hand threaded connector joint. The profile has a lifting shoulder and a torque key. The torque tool lowers through the conductor pipe from the drill rig on drill pipe. It has spring biased dogs that spring outward into the profile. The dogs have lifting surfaces for lifting the conductor string at the lifting shoulder at the profile. Rotating the torque tool causes it to engage the torque key to break out the connector joint.

5 Claims, 2 Drawing Sheets

RELEASE APPARATUS AND METHOD FOR THREADED CONDUCTOR PIPE

BACKGROUND OF THE INVENTION

1. Field of the Invention

This invention relates in general to large diameter, threaded conductor pipe used for offshore drilling, and in particular to an apparatus for breaking out a lower joint of the conductor pipe when the well is suspended.

2. Description of the Prior Art

When drilling from a jackup drilling rig in offshore drilling, large diameter conductor pipe will extend from a selected depth in the earth to a point above the surface of the water and below the rig floor. The conductor pipe will be installed by screwing the threads of the conductor pipe sections together. The uppermost section of conductor pipe will be cut off at a desired point below the rig floor. The threaded connection at the sea floor or slightly above will be a left-hand thread. The rest of the threads will be right-hand.

After drilling the well, often the well will be suspended. The drilling rig will be moved away from the well. It will be necessary to remove the portion of the conductor pipe that extends above the sea floor to the drilling rig. The portion of the conductor pipe that extends into the earth will remain in place.

In the past, this has been a difficult task. Generally, the operator will try to grip the upper section of conductor pipe with a spear or the like, then rotate it to the right. Hopefully, this will cause the lower connection to break out. Then the operator will pull the entire string upward, disconnecting each section one at a time.

Because of the weight of the conductor string on the left-hand threaded joint, there will be a lot of friction at the box nose/pin shoulder interface. This makes it difficult to apply enough torque from the surface to break out this joint. Also, it is difficult to lift the conductor string because there will be no external thread collar at the upper end of the conductor string.

SUMMARY OF THE INVENTION

In this invention, the connector joint to be broken out will be provided with an internal recess or profile. This profile comprises a circumferential groove. It has a downward facing lifting shoulder and an upward facing landing shoulder. Also, it has at least two torque keys. Furthermore, it has at least one release section in the profile where the lifting shoulder is replaced by an upward tapered shoulder.

The apparatus also includes a torque tool which will be lowered from the surface on drill pipe. This torque tool has a body with at least one radially extending dog. The dog will land on the landing shoulder and move outward into the recess. Springs cause this outward movement.

The operator will rotate the drill pipe a slight amount to cause the dog to engage the torque key. The operator will then lift the drill pipe to take weight off the threaded connection below the profile. He will then apply torque, which transmits through the dog to the torque key to break out the joint. Then, the operator will pick up the drill pipe to pull the upper end of the conductor string to the drill rig where slips at the rotary table can be used to support the connector pipe.

The operator then may rotate the torque tool to the left to the release section. He then can pull the drill pipe and torque tool from the conductor string. The operator can then remove the conductor string by utilizing the slips and elevators of the drill rig.

DETAILED DESCRIPTION OF THE INVENTION

Figure 1:
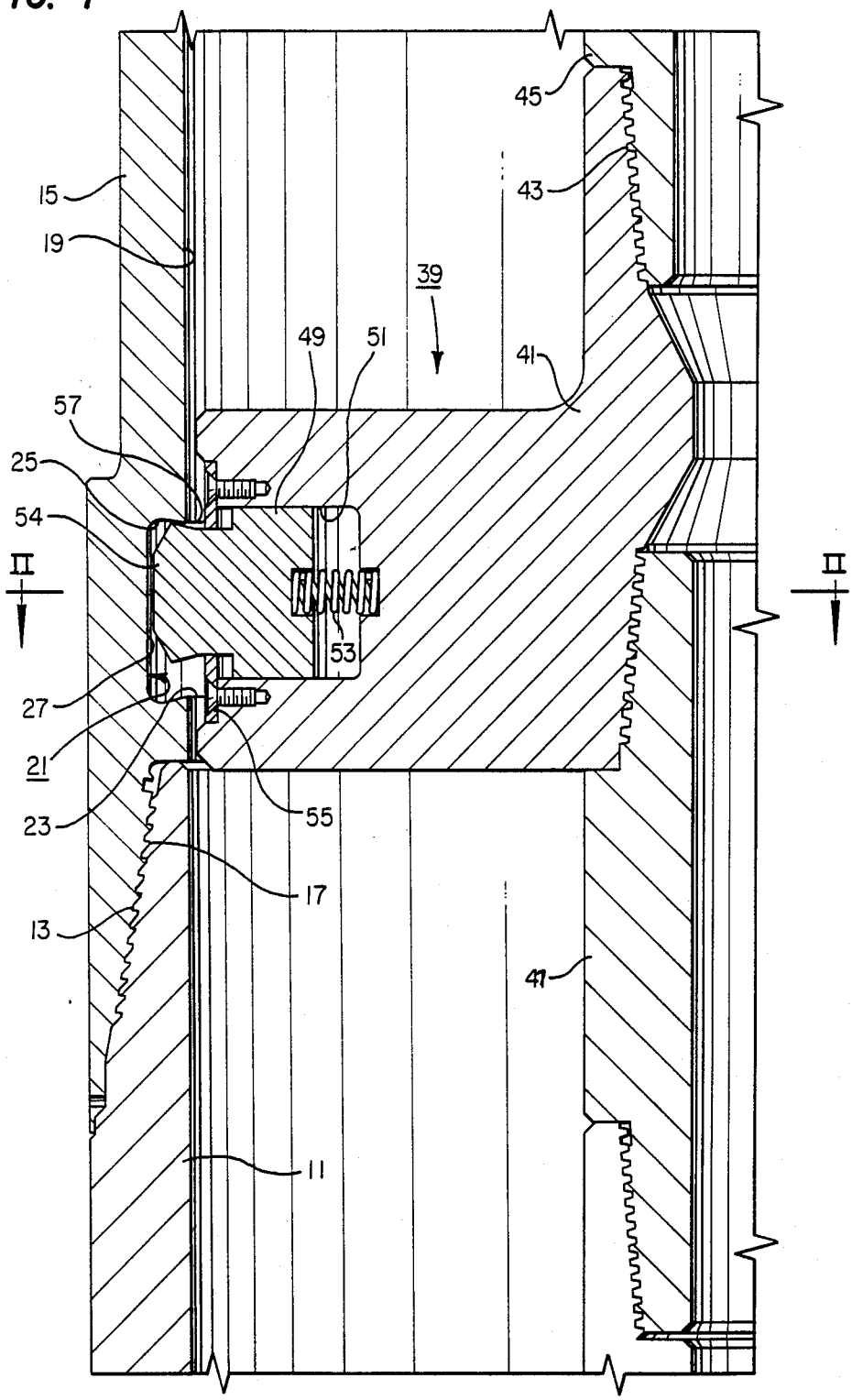
FIG. 1 is a quarter sectional view of a torque tool and connector joint constructed in accordance with this invention.

Referring to FIG. 1, a lower section of conductor pipe 11 will extend from a point not far above the sea floor to a selected depth in the well. Connector pipe 11 has a pin section on its upper end containing exterior threads 13. An upper string of connector pipe 15 has a box on its lower end containing internal threads 17. Threads 17 are left-hand and engage the threads 13. The upper string of conductor pipe 15 will be screwed together in sections with right-hand threaded connections. The upper string of conductor pipe 15 will extend to the drilling rig, at a point below the rig floor.

The conductor pipe 15 has a cylindrical bore 19. A profile 21 will be machined into the bore 19 at a point immediately above the threads 17. Profile 21 is an annular groove. It has a lower landing shoulder 23 and an upper lifting shoulder 25. The landing shoulder 23 and lifting shoulder 25 join a cylindrical wall 27. The cylindrical wall 27 is coaxial with the bore wall 19, but has a greater diameter and is recessed within the profile 21.

The lifting shoulder 25 is not perpendicular to the longitudinal axis of the conductor pipe 15; rather it inclines downward from cylindrical wall 27 to bore 19 at about a 15 degree angle relative to a plane that is perpendicular to the axis of the pipe 15. Similarly, the landing shoulder 23 inclines upward at about a 15 degree angle relative to a plane perpendicular to the longitudinal axis of the conductor pipe 15.

Figure 2:
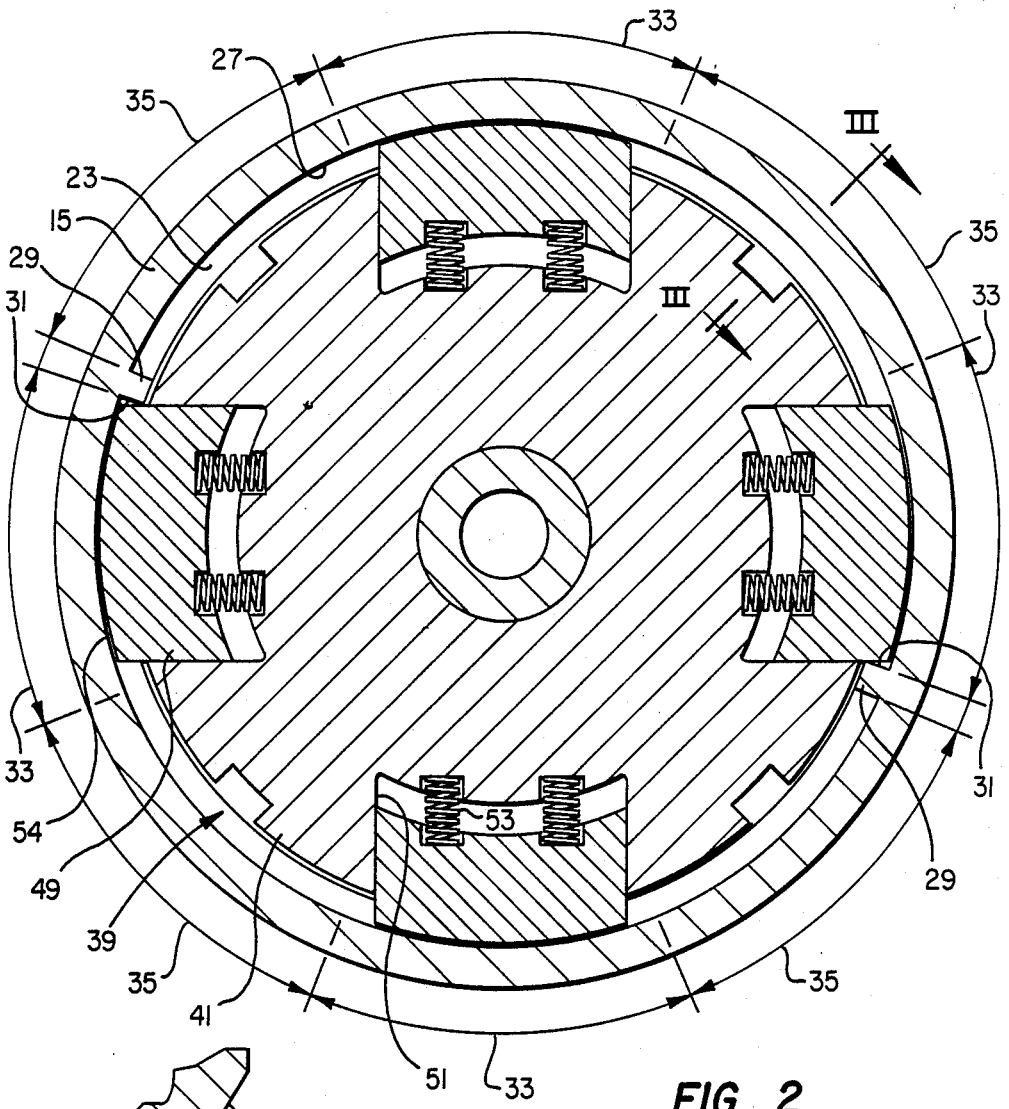
FIG. 2 is a sectional view of the torque tool and connector joint of FIG. 1, taken along the line II—II of FIG. 1.

Cylindrical wall 27 extends circumferentially completely around the conductor pipe 15. As shown in FIG. 2, two torque keys 29 protrude radially outward from the cylindrical wall 27 180 degrees apart from each other. Each torque key 29 comprises a thin rectangular member that has been welded to the cylindrical wall 27 to make it integral with the conductor 15. Each torque key 29 extends axially from the landing shoulder 23 upward to the lifting shoulder 25. Each torque key 29 has an axially extending torque shoulder 31 on one side. Torque shoulder 31 is a wall that is located substantially in a radial plane of the longitudinal axis of the conductor pipe 15. Each torque key 29 extends only about 4 degrees circumferentially and has a side or shoulder on the side opposite torque shoulder 31 that is substantially parallel to the torque shoulder 31.

Referring still to FIG. 2, and also to FIG. 1, the lifting shoulder 25 does not extend completely circumferentially around the profile 21. Rather it comprises four separate circumferentially spaced apart engaging sections 33, illustrated by the arrows of FIG. 2. Each engaging section 33 extends circumferentially about 45 degrees. The engaging sections 33 are uniformly spaced apart from each other.

Figure 3:
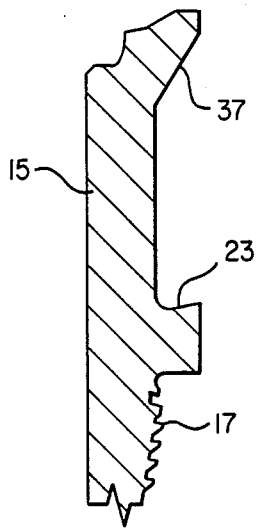
FIG. 3 is a partial sectional view of the torque tool of FIG. 2, taken along the line III—III and shown with the torque tool omitted.

Release sections 35 exist between each of the engaging sections 33. The release sections 35 are sections where the lifting shoulder 25 has been machined into a tapered wall 37, shown in FIG. 3. The tapered wall 37 extends upward from cylindrical wall 27 to bore 19 at about a 30 degree angle relative to the longitudinal axis of the conductor pipe 15. One release section 35 begins at each torque key 29 and extends in an opposite direction from the direction that the torque shoulder 31 faces.

Referring again to FIG. 1, a torque tool 39 will be lowered from the drilling rig into the conductor pipe 15 when the operator wishes to release the conductor pipe 15 from the conductor pipe 11. Torque tool 39 has a body 41 which extends radially outward. Threads 43 on the upper end serve as means for connecting the body 41 to a string of conduit 45, normally drill pipe. A pipe 47 also connects to the lower side of the body 41 and extends downward a short distance.

Four dogs 49, as shown also in FIG. 2, extend radially outward from the body 41. Dogs 49 are evenly spaced apart from each other. Each dog 49 extends circumferentially less than 45 degrees. The dogs 49 are carried in recesses 51 formed in the body 41. Springs 53 force the dogs 49 radially outward. Each dog 49 has an outer portion 54 that will protrude past the outer periphery of the body 41. A retaining plate 55 serves to retain the dogs 49 with the body 41. Each dog 49 has an upper lifting surface 57. The upper lifting surface 57 inclines downward from its outer periphery radially inward at approximately the same angle as the lifting shoulder 25.

In operation, when the operator wishes to release the conductor pipe 15 from the conductor pipe 11, he will lower the torque tool 39 down through the string of conductor pipe 15. Outer portions 54 of the dogs 49 will slide on the bore 19 as the torque tool 39 lowers. When the dogs 49 reach the profile 21, they will spring outward and land on the landing shoulder 23. The outer portion 54 will contact the cylindrical wall 27. The torque tool 39 will not be able to move farther downward.

The operator will then rotate slightly to the right. As shown in FIG. 2, two of the dogs 49 will contact the torque shoulders 31 of the torque keys 29 due to this right-hand rotation. The dogs 49 will be aligned with the engaging sections 33 in this position. Then, the operator will pick up the torque tool 39. The lifting surfaces 57 on the dogs 49 will engage the lifting shoulders 25. The operator lifts upward on the drill pipe 45 to remove weight from the pin nose/box shoulder interface. Then torque will be applied through the drill string to the dogs 49. The dogs 49 will cause the conductor pipe 15 to unscrew from the conductor pipe 11.

The operator then picks up the drill pipe 45 until the first threaded section of the conductor pipe 15 locates above the rotary table. The operator then may place slips around the connector joint of that uppermost section of conductor pipe 15 to support the conductor pipe 15.

Preferably, the operator will then slack off tension in the drill pipe 45 and rotate to the left. The dogs 49 will then rotate around until they contact the opposite sides of the torque keys 29. The dogs 49 will now be in alignment with the release sections 35. The operator will then pick up on the drill pipe 45. The dogs 49 will slide inward on the tapered shoulders 37, freeing the torque tool 39 of the profile 21. The operator can then pull the torque tool 39 to the surface by unscrewing each section of drill pipe 45. The operator then can pull the conductor pipe 15 to the surface by unscrewing each section in a conventional manner using slips and elevators.

The invention has significant advantages. The torque tool makes breaking out the left-hand thread section of the conductor pipe much easier as it lifts the weight of the conductor string at the pin nose/box shoulder interface before the breakout torque is applied. The torque transmits directly to the joint, not through conductor pipe from the surface. The torque tool and profile allow the conductor pipe to be easily brought to the rig floor where slips and elevators can be utilized to pull the conductor string.

While the invention has been shown in only one of its forms, it should be apparent to those skilled in the art that it is not so limited, but is susceptible to various changes without departing from the scope of the invention.

We claim:

1. An apparatus for breaking out a subsea threaded connection within a string of pipe, comprising in combination:

a connector joint formed on an end of one section of pipe, the connector joint having a threaded section;

a profile formed in the interior of the connector joint above the threaded section, the profile having an axially extending torque shoulder and a downward facing lifting shoulder;

a torque tool having a body and adapted to be lowered on a string of conduit through the pipe to the connector joint;

at least one dog mounted to the body;

means for urging the dog radially outward from the body into engagement with the profile;

the dog having an axially extending side for engaging the torque shoulder to unscrew the connector joint when the conduit is rotated; and the dog having an upward facing lifting surface for engaging the lifting shoulder of the profile to pick up the string of pipe above the connector joint by lifting the conduit.

2. An apparatus for breaking out a subsea threaded connection within a string of pipe, comprising in combination:

a connector joint formed on an end of one section of pipe, the connector joint having a cylindrical bore and a threaded section;

a circumferential profile formed in the interior of the connector joint above the threaded section;

the profile having a cylindrical wall recessed from the bore, the cylindrical wall having a diameter greater than the diameter of the bore;

the profile having a downward facing lifting shoulder and an upward facing landing shoulder spaced below the lifting shoulder, the landing shoulder extending circumferentially around the profile;

at least one axially extending torque key in the profile, protruding radially inward from the cylindrical wall and extending from the lifting shoulder to the landing shoulder, the torque key having a torque shoulder;

a torque tool having a body and adapted to be lowered on a string of conduit through the pipe to the connector joint;

at least one dog mounted to the body;

spring means for urging the dog radially outward from the body into engagement with the profile as the torque tool is lowered, the dog having a lower side adapted to land on the landing shoulder;

the dog having an axially extending side for engaging the torque shoulder of the torque key to unscrew the connector joint when the conduit is rotated;

the dog having an upward facing lifting surface for engaging the lifting shoulder of the profile to pick up the string of pipe above the connector joint by lifting the conduit; and a release section formed in the profile, the release section tapering upward from the cylindrical wall to the bore to allow the dog to slide upward from the profile when the dog is aligned with the release section, the release section extending circumferentially a selected distance from the side of the torque key opposite the torque shoulder.

3. A profile formed in a bore of a connector joint of a subsea threaded connection within a string of pipe for engagement by a torque tool having a plurality of spring-biased radially extending dogs, the profile comprising in combination:

a circumferentially extending cylindrical wall recessed from the bore, the cylindrical wall having a diameter greater than the diameter of the bore;

an upward facing landing shoulder at the lower termination of the cylindrical wall, the landing shoulder extending circumferentially around the profile for landing the torque tool;

a plurality of circumferentially spaced apart downward facing lifting shoulders at the upper termination of the cylindrical wall and facing the landing shoulder for receiving the dogs to apply an upward force to the connector joint;

at least one axially extending torque key in the profile, protruding radially inward from the cylindrical wall and extending from the lifting shoulder to the landing shoulder, the torque key having an axially extending torque shoulder for receiving one of the dogs to apply torque to the connector joint; and a plurality of release sections circumferentially spaced between the lifting shoulders, the release sections tapering upward to allow the dogs to slide upward from the profile when the torque tool is rotated to align the dogs with the release sections.

4. A method for breaking out a subsea connector joint within a string of pipe, comprising in combination:

forming a profile in the interior of the connector joint with an axially extending torque shoulder and a downward facing lifting shoulder;

providing a torque tool with at least one dog;

lowering the torque tool on a string of conduit through the pipe to the connector joint;

urging the dog radially outward from the body into engagement with the profile;

rotating the string of conduit until the dog contacts the torque shoulder;

picking up the string of conduit by causing the dog to engage the lifting shoulder; and applying torque to the string of conduit, which transmits through the dog to the torque shoulder to release the connector joint.

5. A method for breaking out a subsea connector joint within a string of pipe located below a drilling rig and for retrieving the string of pipe, comprising in combination:

forming a circumferential recessed profile formed in the interior of the connector joint with an axially extending torque shoulder and a downward facing lifting shoulder interrupted by an upward tapered release section;

providing a torque tool with at least one spring-biased dog;

lowering the torque tool on a string of conduit through the pipe to the connector joint, wherein the dog moves radially outward from the body into engagement with the profile;

positioning the dog in contact with the torque shoulder;

picking up the string of conduit, causing the dog to engage the lifting shoulder and exert an upward force on the pipe located above the connector joint;

applying torque to the string of conduit in an unscrewing direction to cause the dog break out the connector joint; then pulling upward on the string of conduit to pull the pipe up to position the upper end of the pipe at the drilling rig;

supporting the pipe with the drilling rig; then rotating the conduit in an opposite direction to the unscrewing direction until the dog aligns with the release section; then pulling upward on the conduit to release the dog from the profile, and removing the conduit from the pipe; then pulling the pipe upward and removing it by unscrewing one section at a time.

* * * * *